US010750871B1

(12) United States Patent
Smith

(10) Patent No.: US 10,750,871 B1
(45) Date of Patent: Aug. 25, 2020

(54) PORTABLE, FOLDABLE, LIGHTWEIGHT, SURF LOUNGE CHAIR AND METHODS OF MAKING AND USING SAME

(71) Applicant: Glenn Smith, Tamaqua, PA (US)

(72) Inventor: Glenn Smith, Tamaqua, PA (US)

( * ) Notice: Subject to any disclaimer, the term of this patent is extended or adjusted under 35 U.S.C. 154(b) by 0 days.

(21) Appl. No.: 16/789,067

(22) Filed: Feb. 12, 2020

(51) Int. Cl.

| | |
|---|---|
| ***A47C 1/14*** | (2006.01) |
| ***A47C 4/28*** | (2006.01) |
| ***A47C 4/02*** | (2006.01) |
| ***A47C 4/42*** | (2006.01) |
| ***A47C 7/00*** | (2006.01) |

(52) U.S. Cl.
CPC ..... *A47C 1/14* (2013.01); *A47C 4/02* (2013.01); *A47C 4/286* (2013.01); *A47C 4/42* (2013.01); *A47C 7/002* (2013.01)

(58) Field of Classification Search
CPC ..... A47C 1/14
USPC ..... 297/16.2, 45, 344.18
See application file for complete search history.

(56) References Cited

U.S. PATENT DOCUMENTS

| | | | | |
|---|---|---|---|---|
| 8,459,741 | B2 | 6/2013 | Mazzola et al. | |
| 8,465,090 | B1 * | 6/2013 | O'Connor | A47C 7/62 297/45 X |
| 8,899,673 | B2 | 12/2014 | Holland | |
| 9,808,089 | B2 | 11/2017 | Lougee | |
| 10,213,022 | B2 | 2/2019 | Block et al. | |
| 10,342,351 | B2 | 7/2019 | Lenhart | |
| 10,531,742 | B2 * | 1/2020 | Reed | A47C 1/16 |

* cited by examiner

*Primary Examiner* — Anthony D Barfield
(74) *Attorney, Agent, or Firm* — James R. McDaniel

(57) ABSTRACT

A portable, foldable, lightweight chair that can be used by boaters, beach goers, and others to relax in a body of water such as the ocean, a lake, a river, or the like. Also, the chair can be used in water up to four (4) feet deep. In particular, the chair enables the user to anchor the chair into the bottom of the body of water (such as into the sand in the ocean bottom) in which the users are using the chair. Furthermore, the chair includes a netted material that allows the water to flow through the chair to ensure that the chair remains anchored to the bottom of the body of water. Finally, the netted material allows the chair to more easily and quickly dry out once the chair has been removed from the body of water.

17 Claims, 10 Drawing Sheets

PORTABLE, FOLDABLE, LIGHTWEIGHT, SURF LOUNGE CHAIR AND METHODS OF MAKING AND USING SAME

FIELD OF THE INVENTION

The present invention is generally related to a portable, foldable, lightweight chair that can be used by boaters, beach goers, and others to relax in a body of water such as the ocean, a lake, a river, or the like. Also, the chair can be used in water up to four (4) feet deep. In particular, the chair enables the user to anchor the chair into the bottom of the body of water (such as into the sand in the ocean bottom) in which the users are using the chair. Furthermore, the chair includes a netted material that allows the water to flow through the chair to ensure that the chair remains anchored to the bottom of the body of water. Finally, the netted material allows the chair to more easily and quickly dry out once the chair has been removed from the body of water.

BACKGROUND OF THE INVENTION

Prior to the present invention, as set forth in general terms above and more specifically below, it is known, to employ various types of portable, foldable, lightweight chairs. See, for example, U.S. Pat. No. 8,459,741 to Mazzola, U.S. Pat. No. 8,899,674 to Holland, U.S. Pat. No. 9,808,089 to Lougee, U.S. Pat. No. 10,213,022 to Block et al., and U.S. Pat. No. 10,342,351 to Lenhart.

It is further known that individuals like to gather in groups in the water to socialize, drink, or relax. However, these individuals often find it difficult to find a comfortable seating or relaxing position. For example, those individuals who kneel down in the surf often find themselves with irritated knees from the sand. Also, if a float is used, the individuals have to constantly reposition themselves, which adds to the knee irritation. Furthermore, if a conventional lightweight folding chair is used, as discussed above, there is a risk that the conventional lightweight folding chair can dislodge and then float away when the chair is not being used. Finally, it can be difficult to maintain one's position in the water when trying to hold a drink. Therefore, there is a need in the chair art for a new and improved portable, lightweight, foldable chair that can be used by boaters, beach goers, and others to relax in a body of water such that the chair enables the user to anchor the chair into the bottom of the body of water and allows the water to flow through the chair to ensure that the chair remains anchored to the bottom of the body of water. While these various types of chairs are capable of being portable, foldable, and lightweight, it is further desired that the chairs can be used by boaters, beach goers, and others to relax in a body of water such as the ocean, a lake, a river, or the like. Also, the chair can be used in water up to four (4) feet deep. In particular, the chair should be able to allow the user to anchor the chair into the bottom of the body of water (such as into the sand in the ocean bottom) in which the users are using the chair. Furthermore, the chair should include a netted material that allows the water to flow through the chair to ensure that the chair remains anchored to the bottom of the body of water and the netted material allows the chair to more easily and quickly dry out once the chair has been removed from the body of water.

It is a purpose of this invention to fulfill these and other needs in the portable, foldable, lightweight chair art in a manner more apparent to the skilled artisan once given the following disclosure.

BRIEF SUMMARY OF THE INVENTION

A first aspect of the present invention is a portable, foldable, lightweight chair for use in water, including a lower leg extension assembly; an inner leg assembly, wherein the inner leg assembly is located within one end of the lower leg extension assembly such that a length between the lower leg extension assembly and the inner leg assembly is adjustable, wherein the inner leg assembly further comprises an extension tip operatively connected to one end of the inner leg assembly and a stabilizer located adjacent to the extension tip; a front cross-bar assembly operatively connected to the one end of the lower leg extension assembly; a rear cross-bar assembly operatively connected to the one end of the lower leg extension assembly; a plurality of side cross bar assemblies, wherein each side cross assembly is operatively connected to the one end of the lower leg extension assembly and each side cross assembly is located adjacent to the front cross-bar assembly and the rear cross-bar assembly; a back rest assembly operatively connected to another end of the lower leg extension assembly; a plurality of arm rest assemblies operatively connected to the lower leg extension assembly, wherein each of the arm rest assemblies is located adjacent to the back rest assembly; and a seat assembly operatively connected to the lower leg extension assembly, wherein the seat assembly is located adjacent to the plurality of arm rest assemblies.

In one embodiment of the first aspect of the present invention, the lower leg extension assembly further includes a plurality of outer legs, wherein each of the outer legs includes a plurality of openings located along a portion of each of the outer legs.

In another embodiment of the first aspect of the present invention, the inner leg assembly further includes a plurality of inner legs wherein each of the plurality of inner legs includes an end cap located on one end of each of the inner legs, a push button located adjacent to the end cap, wherein the push button interacts with the plurality of openings once each of the inner legs is located with the outer leg, an inner leg opening located at the other end of each of the inner legs such that the extension tip is removably located within the inner leg opening, and a drain hole located adjacent to the inner leg opening.

In a still another embodiment of the first aspect of the present invention, the stabilizer includes a stabilizer plate.

In a further embodiment of the first aspect of the present invention, the back rest assembly further includes a plurality of reinforced ends, a piping trim operatively connected to each of the plurality of reinforced ends, and a mesh operatively connected to the plurality of reinforced ends and the piping trim.

In a still further embodiment of the first aspect of the present invention, the plurality of arm rest assemblies further includes a plurality of reinforced ends, a piping trim operatively connected to each of the plurality of reinforced ends, and a mesh operatively connected to the plurality of reinforced ends and the piping trim.

In an even further embodiment of the first aspect of the present invention, the seat assembly further includes a plurality of reinforced corners, wherein each of the plurality of reinforced corners includes an opening, a piping trim operatively connected to each of the plurality of reinforced corners, and a mesh operatively connected to the plurality of reinforced corners and the piping trim.

A second aspect of the present invention is a surf lounge chair for use in water, including a lower leg extension assembly; an inner leg assembly, wherein the inner leg assembly is located within one end of the lower leg extension assembly such that a length between the lower leg extension assembly and the inner leg assembly is adjustable, wherein the inner leg assembly further comprises an extension tip operatively connected to one end of the inner leg assembly and a stabilizer located adjacent to the extension tip; a front cross-bar assembly operatively connected to the one end of the lower leg extension assembly; a rear cross-bar assembly operatively connected to the one end of the lower leg extension assembly; a plurality of side cross bar assemblies, wherein each side cross assembly is operatively connected to the one end of the lower leg extension assembly and each side cross assembly is located adjacent to the front cross-bar assembly and the rear cross-bar assembly; a back rest assembly operatively connected to another end of the lower leg extension assembly; a plurality of arm rest assemblies operatively connected to the lower leg extension assembly, wherein each of the arm rest assemblies is located adjacent to the back rest assembly; and a seat assembly operatively connected to the lower leg extension assembly, wherein the seat assembly is located adjacent to the plurality of arm rest assemblies.

In one embodiment of the second aspect of the present invention, the lower leg extension assembly further includes a plurality of outer legs, wherein each of the outer legs includes a plurality of openings located along a portion of each of the outer legs.

In another embodiment of the second aspect of the present invention, the inner leg assembly further includes a plurality of inner legs wherein each of the plurality of inner legs includes an end cap located on one end of each of the inner legs, a push button located adjacent to the end cap, wherein the push button interacts with the plurality of openings once each of the inner legs is located with the outer leg, an inner leg opening located at the other end of each of the inner legs such that the extension tip is removably located within the inner leg opening, and a drain hole located adjacent to the inner leg opening.

In a still another embodiment of the second aspect of the present invention, the stabilizer includes a stabilizer plate.

In a further embodiment of the second aspect of the present invention, the back rest assembly further includes a plurality of reinforced ends, a piping trim operatively connected to each of the plurality of reinforced ends, and a mesh operatively connected to the plurality of reinforced ends and the piping trim.

In a still further embodiment of the second aspect of the present invention, the plurality of arm rest assemblies further includes a plurality of reinforced ends, a piping trim operatively connected to each of the plurality of reinforced ends, and a mesh operatively connected to the plurality of reinforced ends and the piping trim.

In an even further embodiment of the second aspect of the present invention, the seat assembly further includes a plurality of reinforced corners, wherein each of the plurality of reinforced corners includes an opening, a piping trim operatively connected to each of the plurality of reinforced corners, and a mesh operatively connected to the plurality of reinforced corners and the piping trim.

A third aspect of the present invention is a method of using a portable, foldable, lightweight chair in water, including the steps of: providing a lower leg extension assembly; providing an inner leg assembly, wherein the inner leg assembly is located within one end of the lower leg extension assembly such that a length between the lower leg extension assembly and the inner leg assembly is adjustable, wherein the inner leg assembly further comprises an extension tip operatively connected to one end of the inner leg assembly and a stabilizer located adjacent to the extension tip; providing a front cross-bar assembly operatively connected to the one end of the lower leg extension assembly; providing a rear cross-bar assembly operatively connected to the one end of the lower leg extension assembly; providing a plurality of side cross bar assemblies, wherein each side cross assembly is operatively connected to the one end of the lower leg extension assembly and each side cross assembly is located adjacent to the front cross-bar assembly and the rear cross-bar assembly; providing a back rest assembly operatively connected to another end of the lower leg extension assembly; providing a plurality of arm rest assemblies operatively connected to the lower leg extension assembly, wherein each of the arm rest assemblies is located adjacent to the back rest assembly; and providing a seat assembly operatively connected to the lower leg extension assembly, wherein the seat assembly is located adjacent to the plurality of arm rest assemblies.

In one embodiment of the third aspect of the present invention, the step of providing the lower leg extension assembly further includes the step of providing a plurality of outer legs, wherein each of the outer legs includes a plurality of openings located along a portion of each of the outer legs.

In another embodiment of the third aspect of the present invention, the step of providing the inner leg assembly further includes the steps of providing a plurality of inner legs wherein each of the plurality of inner legs is comprised of: providing an end cap located on one end of each of the inner legs; providing a push button located adjacent to the end cap, wherein the step of adjusting the length between the lower leg extension assembly and the inner leg assembly push button interacts with the plurality of openings once each of the inner legs is located with the outer leg, wherein the length between the lower leg extension assembly and the inner leg assembly is adjusted by: pushing on the push button; sliding the inner leg within the outer leg until a desired length between the lower leg extension assembly and the inner leg assembly is achieved; and locating the push button within one of the openings in the outer leg in order to maintain the desired length between the lower leg extension assembly and the inner leg assembly.

In a further embodiment of the third aspect of the present invention, the step of providing the back rest assembly further includes the steps of: providing a plurality of reinforced ends; providing a piping trim operatively connected to each of the plurality of reinforced ends; and providing a mesh operatively connected to the plurality of reinforced ends and the piping trim.

In a still further embodiment of the third aspect of the present invention, the step of providing the arm rest assemblies further includes the steps of: providing a plurality of reinforced ends; providing a piping trim operatively connected to each of the plurality of reinforced ends; and providing a mesh operatively connected to the plurality of reinforced ends and the piping trim.

In an even further embodiment of the third aspect of the present invention, the step of providing the seat assembly further includes the steps of: providing a plurality of reinforced corners, wherein each of the plurality of reinforced corners includes an opening; providing a piping trim operatively connected to each of the plurality of reinforced corners; and providing a mesh operatively connected to the plurality of reinforced corners and the piping trim.

The preferred portable, foldable, lightweight chair, according to various embodiments of the present invention, offers the following advantages: ease of use; lightness in weight; durability; rust resistance; corrosion resistance; the ability to use the chair in up to four (4) feet of water; the reduced likelihood that the chair will float away once the end user gets up from the chair, the ability to anchor the chair to the bottom of the body of water; portability; foldability; the ability to quickly dry out after use in the water; the ability to have the water quickly drain from the chair, and the ability to hold a person without collapsing. In fact, in many of the preferred embodiments, these advantages are optimized to an extent that is considerably higher than heretofore achieved in prior, known, portable, foldable, lightweight chairs.

BRIEF DESCRIPTION OF THE DRAWINGS

The above-mentioned features and steps of the invention and the manner of attaining them will become apparent, and the invention itself will be best understood by reference to the following description of the embodiments of the invention in conjunction with the accompanying drawings, wherein like characters represent like parts throughout the several views and in which.

DETAILED DESCRIPTION OF THE PREFERRED EMBODIMENTS OF THE INVENTION

Figure 1:
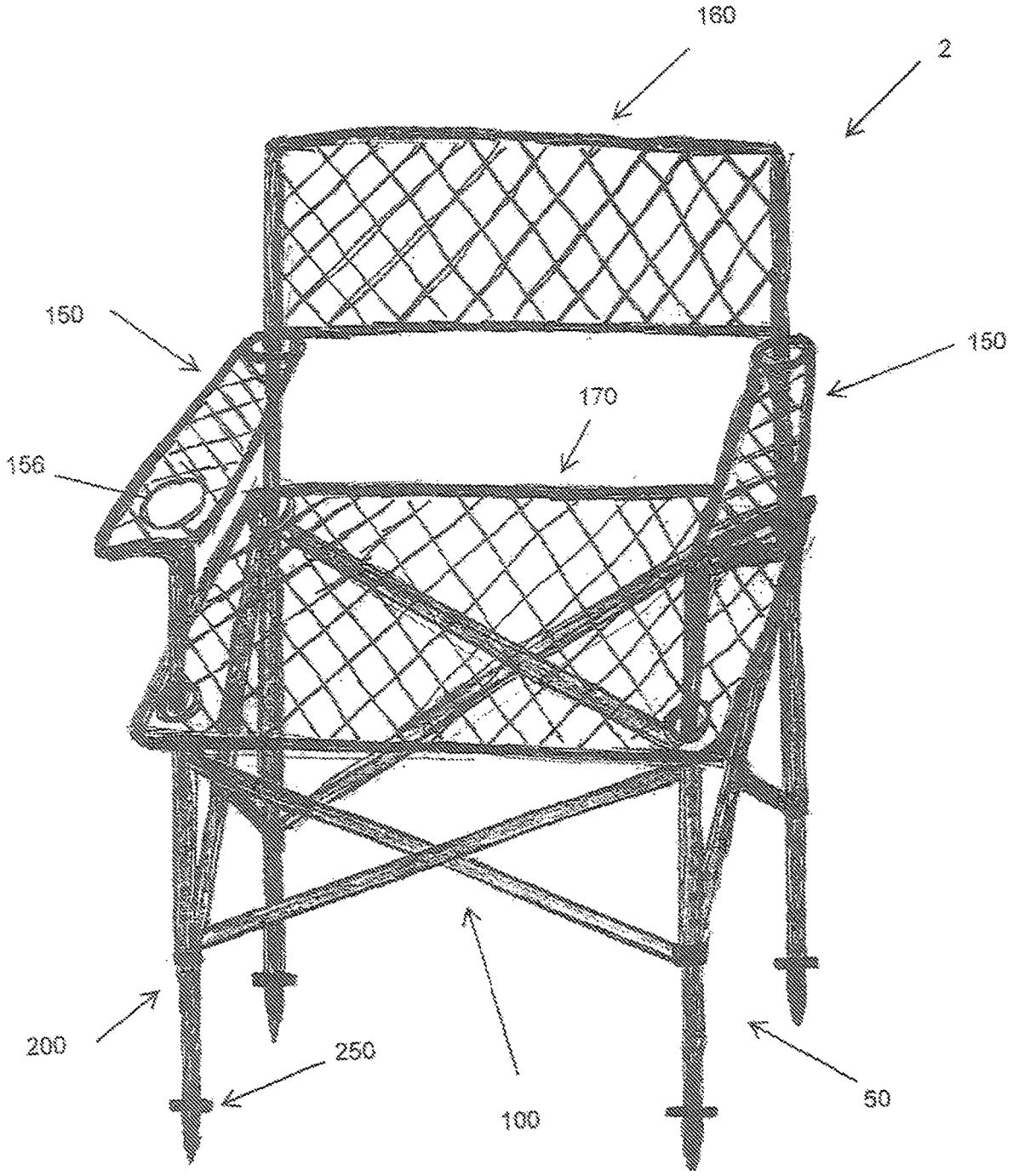
FIG. 1 is a schematic, isometric view of a portable, foldable, lightweight surf lounge chair, constructed according to the present invention.

In order to address the previously discussed shortcomings of the known portable, foldable, lightweight chairs, reference is made now to FIG. 1, where there is illustrated a portable, foldable, lightweight surf lounge chair 2. As will be explained hereinafter in greater detail, the foldable, lightweight surf lounge chair 2 can be used by boaters, beach goers, and others to relax in a body of water such as the ocean, a lake, a river, or the like. Also, the chair can be used in water up to four (4) feet deep. In particular, the chair enables the user to anchor the foldable, lightweight surf lounge chair 2 into the bottom 4 (FIG. 13) of the body of water (such as into the sand in the ocean bottom 4) in which the users are using the foldable, lightweight surf lounge chair 2. Furthermore, the foldable, lightweight surf lounge chair 2 includes a netted material that allows the water to flow through the foldable, lightweight surf lounge chair 2 to ensure that the foldable, lightweight surf lounge chair 2 remains anchored to the bottom 4 of the body of water and the netted material allows the chair to more easily and quickly dry out once the chair has been removed from the body of water.

As shown in FIG. 1, there is illustrated a new and unique foldable, lightweight surf lounge chair 2 which includes lower leg extension assembly 50, front and rear cross-bar assemblies 100, side cross bar assemblies 200, arm rest assemblies 150, back rest assembly 160, seat rest assembly 170, and inner leg assembly 250.

Figure 2:
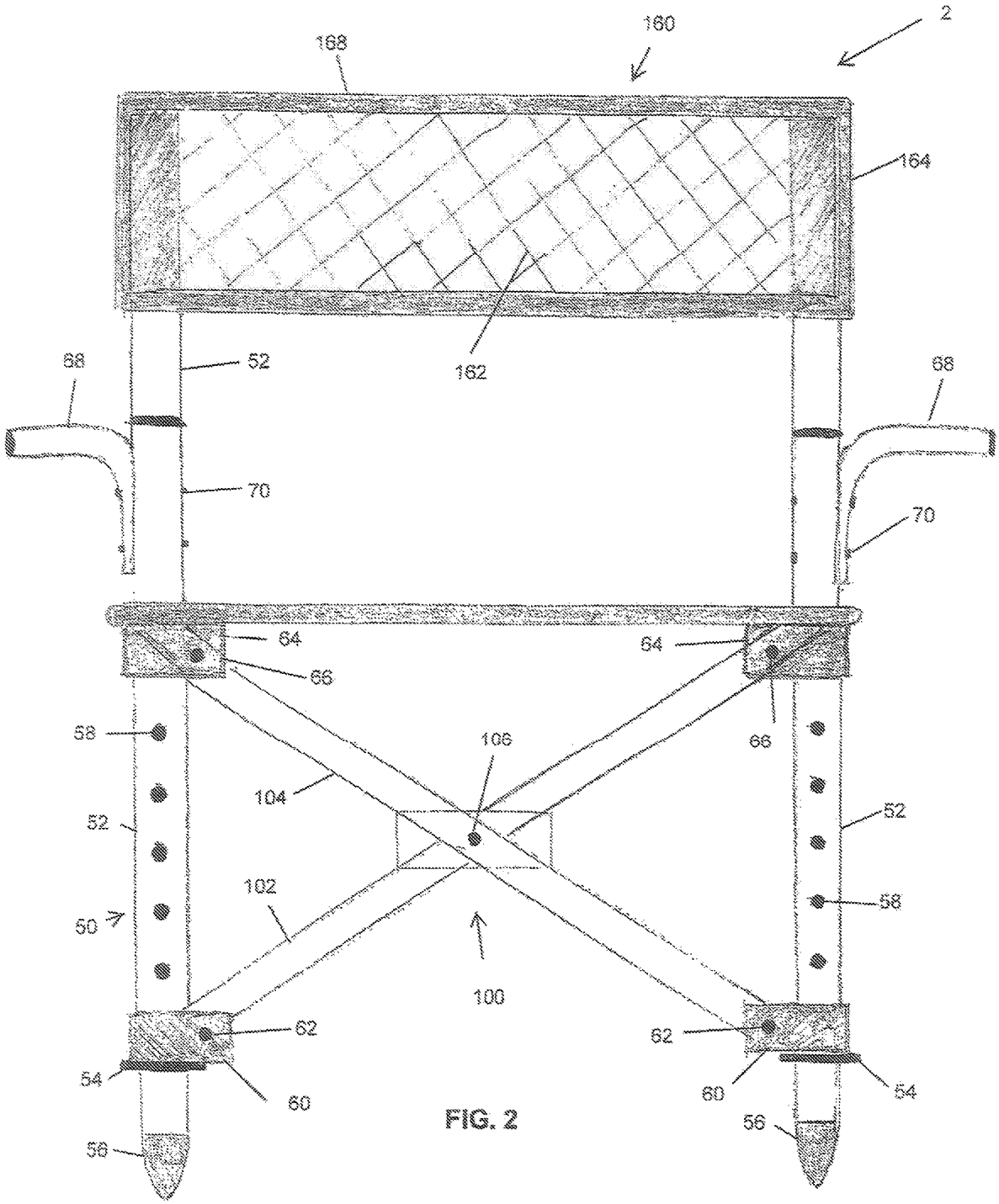
FIG. 2 is a schematic, front view of the portable, foldable, lightweight surf lounge chair, constructed according to the present invention.
Figure 3:
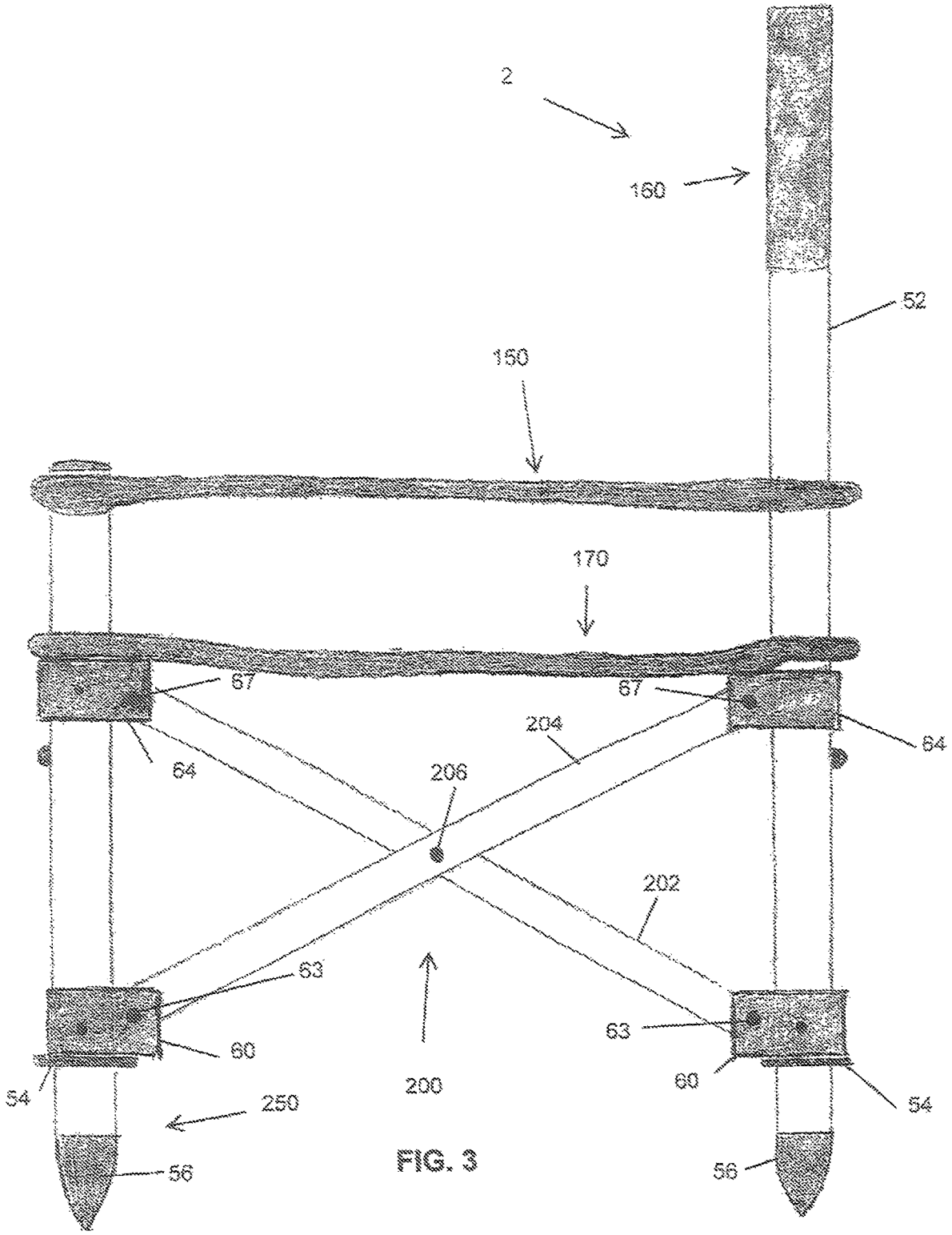
FIG. 3 is a schematic, side view of the portable, foldable, lightweight surf lounge chair, constructed according to the present invention.
Figure 4:
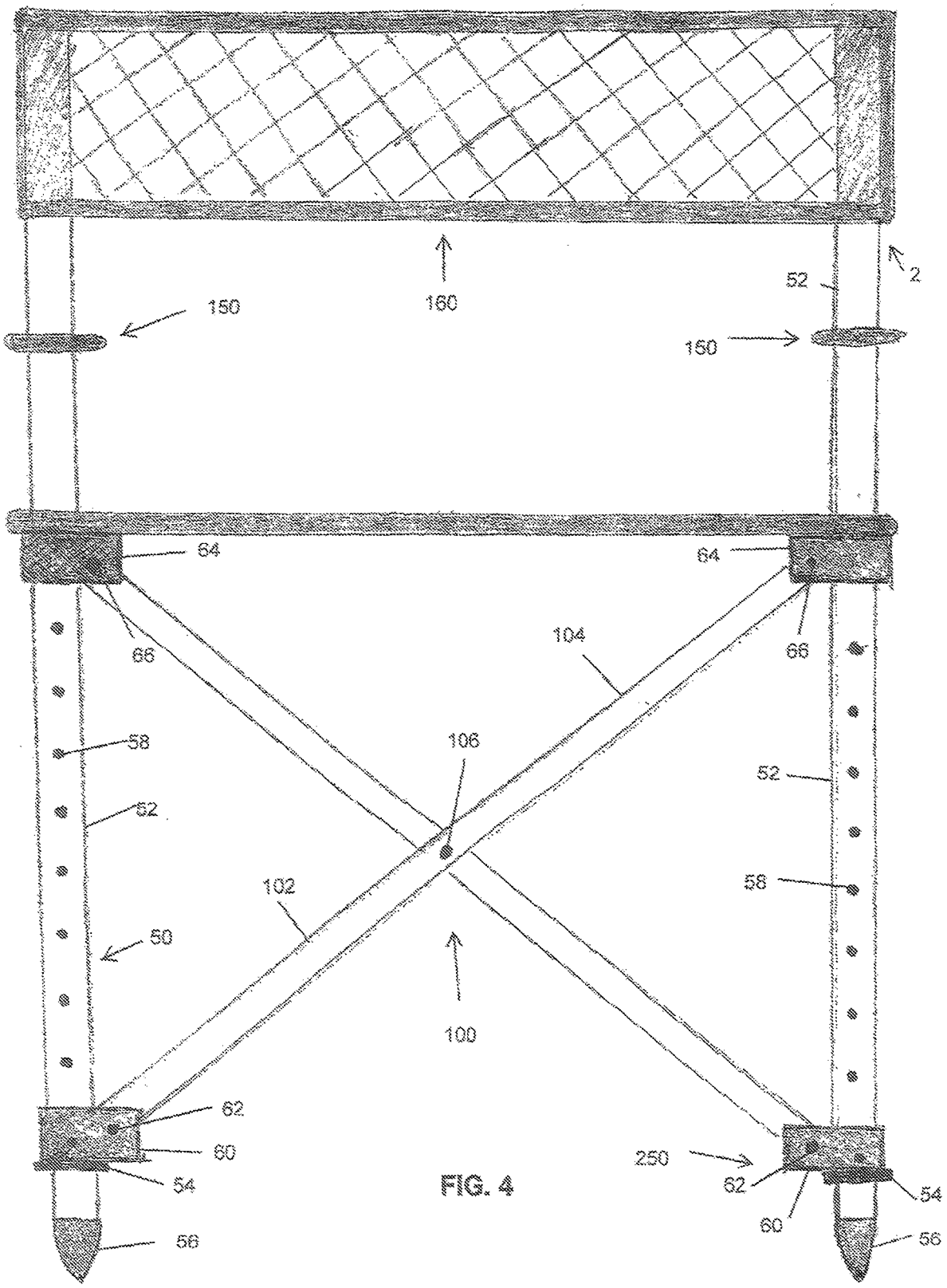
FIG. 4 is a schematic, back view of the portable, foldable, lightweight surf lounge chair, constructed according to the present invention

With respect to lower leg extension assemblies 50, attention is now directed to FIGS. 2-4. As shown in FIGS. 2-4, lower leg extension assemblies 50 include outer leg 52, leg openings 58, connector 60, fasteners 62, connector 64, and fasteners 66. Outer leg 52, fasteners 62, and fasteners 66, preferably, are constructed of any suitable, lightweight material that is durable, UV resistant, high-strength, impact resistant, rust resistant, and temperature resistant, such as aluminum or the like. Connector 60 and connector 64, preferably, are constructed of any suitable, lightweight polymeric material that is durable, impact resistant, UV resistant, rust resistant, and temperature resistant. As shown in FIGS. 2-4, connector 60 is conventionally attached near the bottom end of outer leg 52 and connector 64 is slidably located on outer leg 52, as will be discussed in greater detail later. In this manner, connectors 62 remain located towards the bottom of outer leg 52 and connectors 64 will be able to conventionally slide along a length of outer leg 52 as portable, foldable, lightweight surf lounge chair 2 is folded up or unfolded, as will be discussed in greater detail later.

A unique aspect of the present invention is the use of lower leg extension assemblies 50. As shown in FIGS. 1-4, there are four (4) lower leg extension assemblies 50 attached to portable, foldable, lightweight surf lounge chair 2. The four (4) lower leg extension assemblies 50 allow the portable, foldable, lightweight surf lounge chair 2 to be used in water up to four (4) feet deep. In particular, the portable, foldable, lightweight surf lounge chair 2 enables the user to anchor the portable, foldable, lightweight surf lounge chair 2 into the bottom 4 (FIG. 13) of the body of water (such as into the sand in the ocean bottom 4) in which the users are using the portable, foldable, lightweight surf lounge chair 2 (FIG. 13), as will be discussed in greater detail later.

With respect to front and rear cross-bar assemblies 100, attention is also directed to FIGS. 2-4. As shown in FIGS. 2-4, front and rear cross-bar assemblies 100 include cross bars 102 and 104 and cross bar connector 106. Cross bars 102 and 104 and cross bar connector 106, preferably, are constructed of any suitable, lightweight material that is durable, impact resistant, UV resistant, high-strength, rust resistant, and temperature resistant, such as aluminum or the like. As further shown in FIGS. 2-4, cross bars 102 and 104 are pivotally conventionally connected at one end to connectors 60 by conventional fasteners 62. The other ends of cross bars 102 and 104 are pivotally conventionally connected at one end to connectors 64 by conventional fasteners 66. Finally, cross bars 102 and 104 are pivotally conventionally connected together by conventional fastener 106. In this manner, as portable, foldable, lightweight surf lounge chair 2 is conventionally folded up or unfolded, front and rear cross-bar systems 100 can pivot with respect to each other and rotate in connectors 60 and 64 to easily allow portable, foldable, lightweight surf lounge chair 2 to be folded up or unfolded, as will be discussed in greater detail later. It is to be understood that there is a front cross-bar assembly 100 located at the front of the portable, foldable, lightweight surf lounge chair 2 and a rear cross-bar assembly 100 located at the rear/back of the portable, foldable, lightweight surf lounge chair 2. It is to be further understood that front cross-bar assembly 100 and rear cross-bar assembly 100 are constructed in substantially the same manner.

With respect to side cross-bar assemblies 200, attention is also directed to FIGS. 2-4. As shown in FIGS. 2-4, side cross-bar assemblies 100 include cross bars 202 and 204 and cross bar connector 206. Cross bars 202 and 204 and cross bar connector 206, preferably, are constructed of any suitable, lightweight material that is durable, impact resistant, rust resistant, UV resistant, high strength, and temperature resistant, such as aluminum or the like. As further shown in FIGS. 2-4, cross bars 202 and 204 are pivotally conventionally connected at one end to connectors 60 by conventional fasteners 63. The other ends of cross bars 202 and 204 are pivotally conventionally connected at one end to connectors 64 by conventional fasteners 67. Finally, cross bars 202 and 204 are pivotally conventionally connected together by conventional fastener 206. In this manner, as portable, foldable, lightweight surf lounge chair 2 is conventionally folded up or unfolded, side cross-bar systems 200 can pivot with respect to each other and rotate in connectors 60 and 64 to easily allow portable, foldable, lightweight surf lounge chair 2 to be folded up or unfolded, as will be discussed in greater detail later. It is to be understood that each side cross-bar system 200 is located at each side of the portable, foldable, lightweight surf lounge chair 2.

With respect to lower leg extension assemblies 50, attention is now directed to FIGS. 1-6. As shown in FIGS. 1-6 and, particularly, FIGS. 5 and 6, lower leg extension assemblies 50 further include arm rest extension 68, fasteners 70, end cap 72, and end cap 74. Arm rest extension 68 and fasteners, preferably, are constructed of any suitable, lightweight material that is durable, impact resistant, UV resistant, rust resistant, high strength, and temperature resistant, such as aluminum or the like. End caps 72 and 74, preferably, are constructed of any suitable, lightweight polymeric material that is durable, impact resistant, rust resistant, UV resistant, and temperature resistant.

Figure 5:
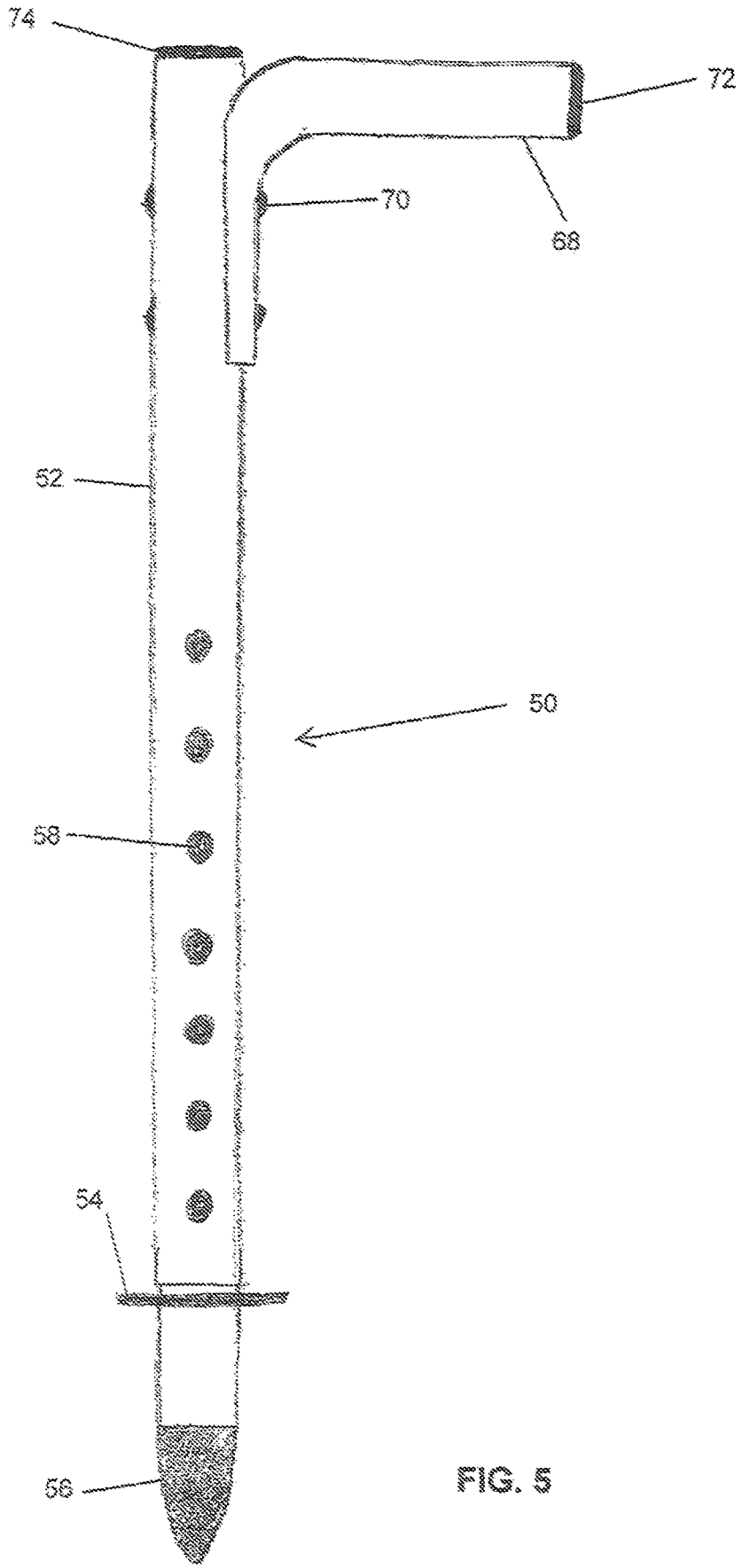
FIG. 5 is a schematic, side view of a front leg assembly of the portable, foldable, lightweight surf, constructed according to the present invention.
Figure 6:
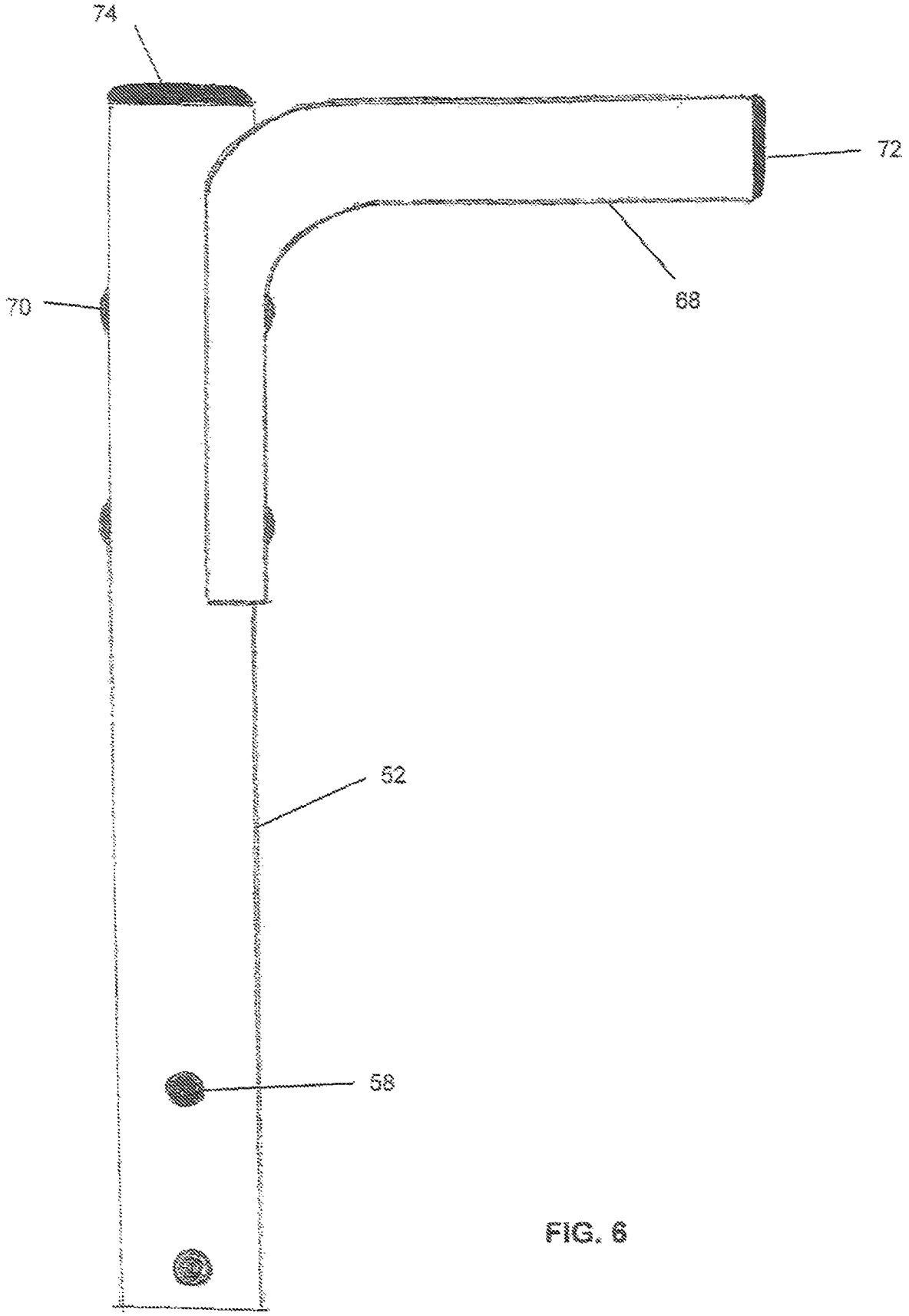
FIG. 6 is a schematic, side view of an upper end of the front leg assembly of the portable, foldable, lightweight surf lounge chair, constructed according to the present invention.

As can be seen best in FIGS. 5 and 6, one end of arm rest extension 68 is conventionally fastened to outer leg 52 by conventional fasteners 70. As can be further seen in FIGS. 5 and 6, once arm rest extension 68 is conventionally fastened to outer leg 52, arm rest extension 68 extends outwardly away from outer leg 52 so that one end of arm rest assembly 150 can be attached to arm rest extension 68, as will be discussed in greater detail later. It is to be understood that end cap 72 is conventionally attached to the other end of arm rest extension 68 in order to protect the user from inadvertently contacting the open end of arm rest extension 68. Also, end cap 74 is conventionally attached to the other end of outer leg 52 in order to protect the user from inadvertently contacting the open end of outer leg 52.

Another unique aspect of the present invention is the use of openings 58. As shown in FIGS. 1, 2, and 4-6, openings 58 are located along a length of outer leg 52. Openings 58, preferably, are formed in outer leg 52 by conventional opening forming techniques such as drilling, punching or the like. It is to be understood that the size of openings 58 must be such that push button 72 (FIGS. 7 and 8) on inner leg assembly 250 will easily fit within each of the openings 58 but still allow push button 72 to remain within the opening 58 once push button 72 has been located within a particular opening 58, as will be discussed in greater detail later. In this manner, push button 72 and openings 58 can be used to retain the desired length between outer leg 52 and inner leg assembly 250, as will be discussed in greater detail later.

Figure 7:
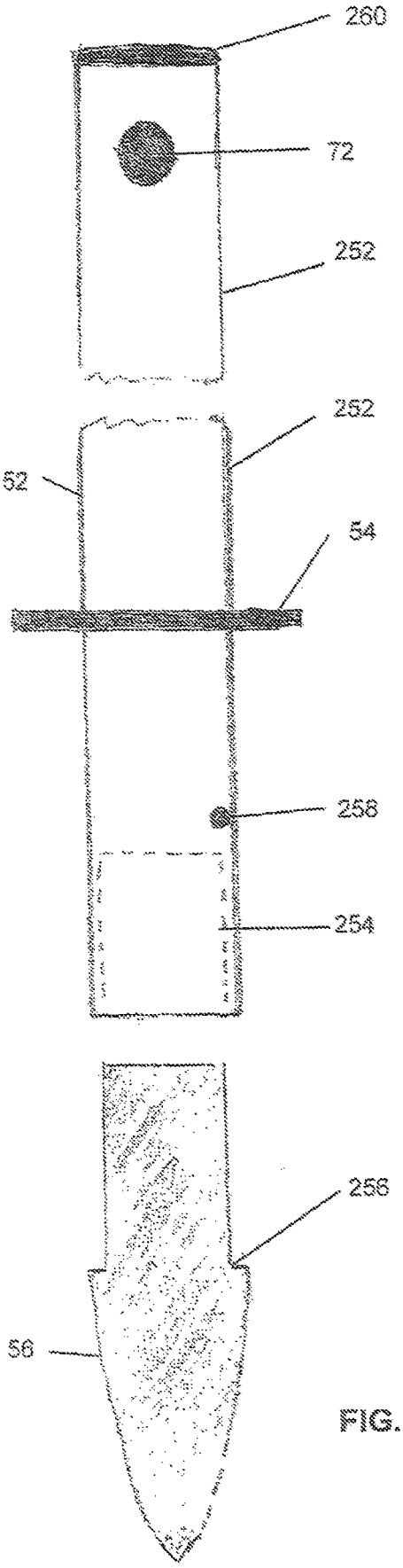
FIG. 7 is a schematic, exploded, side view of an inner leg assembly of the portable, foldable, lightweight surf lounge chair, constructed according to the present invention.
Figure 8:
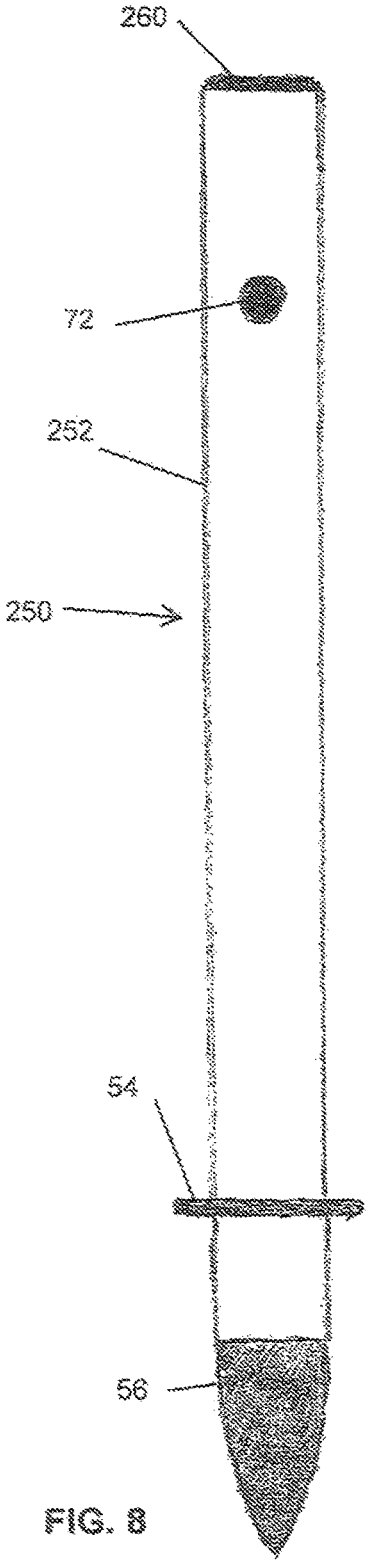
FIG. 8 is a schematic, side view of the constructed inner leg assembly of the portable, foldable, lightweight surf lounge chair, constructed according to the present invention.

With respect to inner leg assembly 250, attention is now directed to FIGS. 7 and 8. As shown in FIGS. 7 and 8, inner leg assembly 250 includes inner leg 252, stabilizing plate 54, leg extension tip 56, push button 72, inner leg opening 254, leg extension tip notch 256, drain hole 258, and end cap 260. Inner leg 252, stabilizing plate 54, and push button 72, preferably, are constructed of any suitable, lightweight material that is durable, impact resistant, rust resistant, UV resistant, high strength, and temperature resistant, such as aluminum or the like. Leg extension tip 56 and end cap 260, preferably, are constructed of any suitable, lightweight polymeric material that is durable, impact resistant, rust resistant, UV resistant, and temperature resistant. It is to be understood that push button 72 is conventionally located within the end of inner leg 252 by conventional techniques. Also, stabilizing plate 54 is conventionally attached to inner leg 252 by conventional material attaching techniques such as welding, soldering, adhesives, or the like. It is also to be understood that the overall size (thickness and width/diameter) of stabilizing plate 54 should be such that stabilizing plate 54, along with leg extension tip 56, will adequately anchor the portable, foldable, lightweight surf lounge chair 2 in the bottom 4 (FIG. 13) of the body of water. Also, drain hole 258 is formed in inner leg 252 by conventional opening forming techniques such as drilling, stamping, or the like.

Another unique aspect of the present invention is the use of leg extension tip 56. As shown in FIGS. 7 and 8, leg extension tip 56 includes a notch 256. Leg extension tip 56 is located on the end of inner leg 252 so that leg extension tip 56 is located adjacent to inner leg opening 254. Leg extension tip 56 is then inserted into inner leg opening 254 until leg extension tip notch 256 contacts the end of inner leg 252 and leg extension tip 56 is firmly retained within the end of inner leg 252 (FIG. 8). However, the construction of leg extension tip 56 also allows leg extension tip 56 to be removed and replaced with another leg extension tip 56 if the leg extension tip 56 is damaged and/or broken.

A unique aspect of the present invention is the use of inner leg assemblies 250. As shown in FIGS. 1-4, there are four (4) inner leg assemblies 250 with each of the inner leg assemblies 250 being attached to attached to one of the four (4) lower leg extension assemblies 50 in the portable, foldable, lightweight surf lounge chair 2. The four (4) lower leg extension systems 50 in conjunction with the four (4) inner leg assemblies 250 allow the portable, foldable, lightweight surf lounge chair 2 to be used in water up to four (4) feet deep. In particular, the chair enables the user to anchor the portable, foldable, lightweight surf lounge chair 2 into the bottom 4 (FIG. 13) of the body of water (such as into the sand in the ocean bottom 4) in which the users are using the portable, foldable, lightweight surf lounge chair 2, as will be discussed in greater detail later.

Figure 9:
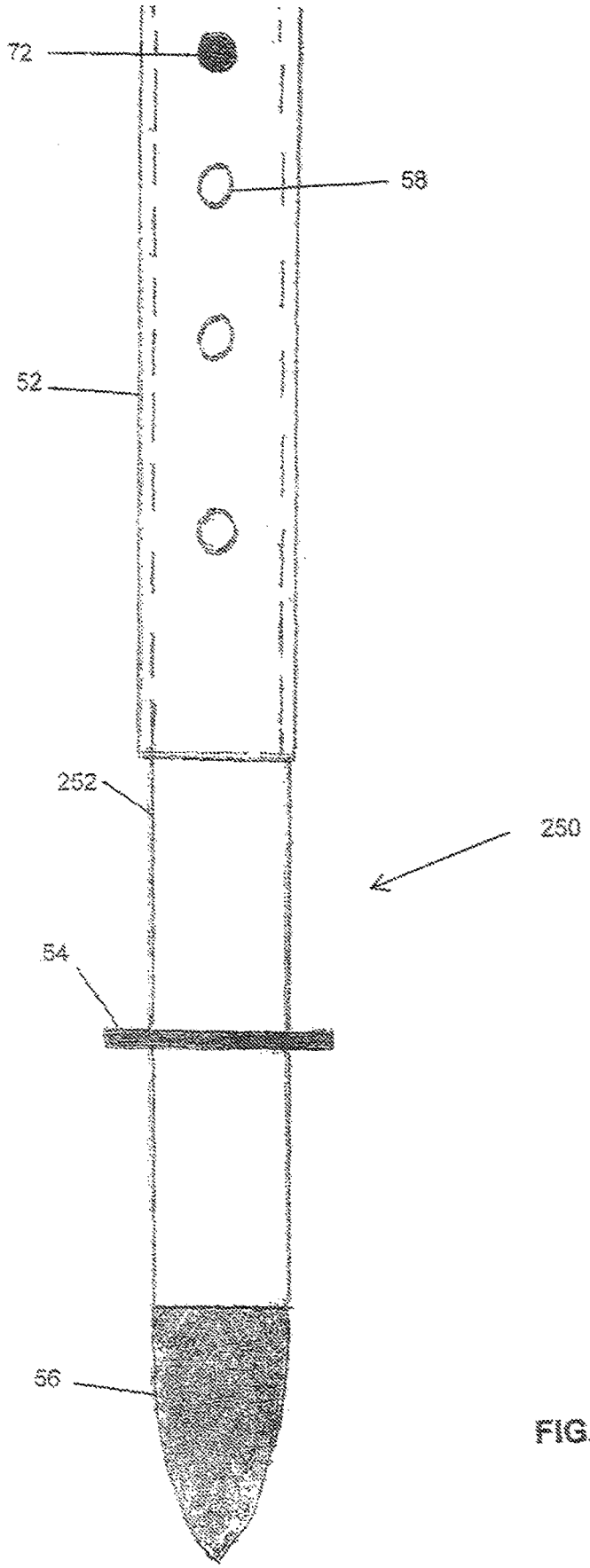
FIG. 9 is a schematic, side view of the lower leg extension assembly of the portable, foldable, lightweight surf lounge chair with the inner leg assembly extended, constructed according to the present invention.

With respect to inner leg assembly 250, attention is now directed to FIG. 9. As shown in FIG. 9, lower leg extension assembly 50 and inner leg assembly 250 are shown in an extended position. In particular, push button 72 has been pushed in or otherwise activated so that inner leg 252 can be pulled away from outer leg 52. The push button 72 is then located within the desired opening 58 so that inner leg 252 is extended the desired distance away from outer leg 52, as will be discussed in greater detail later.

A yet another unique aspect of the present invention is the use of inner leg 252 and outer leg 52. As discussed above, push button 72 is pushed in or otherwise activated so that inner leg 252 can be pulled away from outer leg 52. The push button 72 is then located within the desired opening 58 so that inner leg 252 is extended the desired distance away from outer leg 521. In this manner, the overall length between outer leg 52 and inner leg 252 can be adjusted by the end user so that the height of the seat assembly 170 away from the ground or the bottom 4 (FIG. 13) of the body of water (such as a lake, river, ocean, or the like) can be adjusted to the desired height for the end user.

Figure 10:
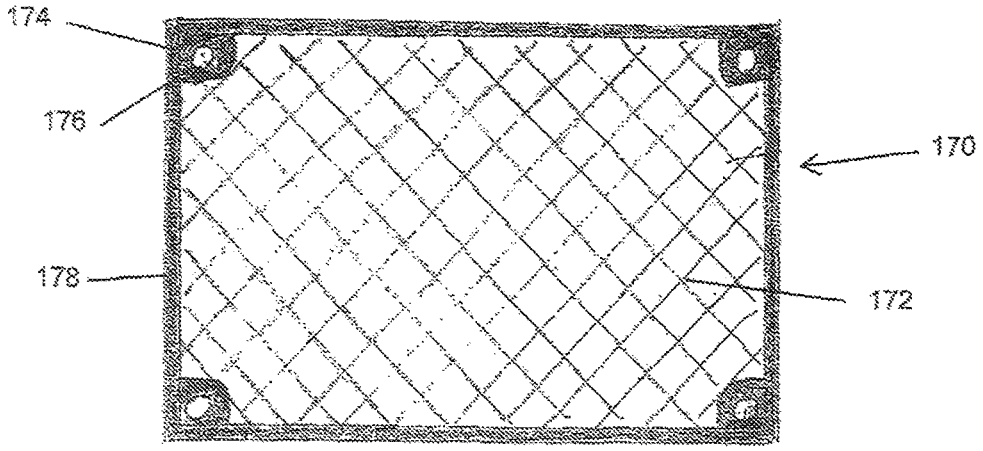
FIG. 10 is a schematic, top view of the seat assembly of the portable, foldable, lightweight surf lounge chair, constructed according to the present invention.

With respect to seat assembly 170, attention is now directed to FIG. 10. As shown in FIG. 10, seat assembly 170 includes mesh or netting 172, reinforced corners 174, openings 176, and piping trim 178. Mesh or netting 172, reinforced corners 174, and piping trim 178, preferably, are constructed of any suitable, lightweight material that is durable, impact resistant, stretch resistant, rust resistant, UV resistant, and temperature resistant. It is to be understood that the overall size of seat assembly 170 should be that it adequately covers a seating area for the end user when the portable, foldable, lightweight surf lounge chair 2 is unfolded.

A further unique aspect of the present invention is the use of seat assembly 170. In particular, the seat assembly 170 includes the mesh or netting 172 that allows the water to flow through the portable, foldable, lightweight surf lounge chair 2 to ensure that the portable, foldable, lightweight surf lounge chair 2 remains anchored to the bottom 4 (FIG. 13) of the body of water. Also, the mesh or netting 172 allows the portable, foldable, lightweight surf lounge chair 2 to more easily and quickly dry out once the chair 2 has been removed from the body of water.

Figure 11:
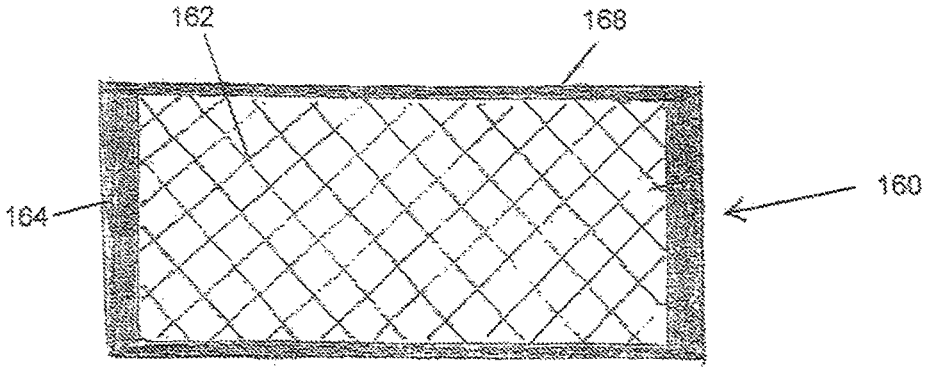
FIG. 11 is a schematic, front view of the back rest assembly of the portable, foldable, lightweight surf lounge chair, constructed according to the present invention.

With respect to back rest assembly 160, attention is now directed to FIG. 11. As shown in FIG. 11, back rest assembly 160 includes mesh or netting 162, reinforced ends 164, and piping trim 168. It is to be understood that mesh or netting 162 should be constructed of substantially the same material as mesh or netting 172. Also, reinforced ends 164 should be constructed of substantially the same material as reinforced corners 174. Finally, piping trim 168 should be constructed of substantially the same material as piping trim 178. It is to be understood that the overall size of back rest assembly 160 should be that it adequately provides a back rest area for the end user when the portable, foldable, lightweight surf lounge chair 2 is unfolded.

A further unique aspect of the present invention is the use of back rest assembly 160. In particular, the back rest assembly 160 includes the mesh or netting 162 that allows the water to flow through the portable, foldable, lightweight surf lounge chair 2 to ensure that the portable, foldable, lightweight surf lounge chair 2 remains anchored to the bottom 4 (FIG. 13) of the body of water. Also, the mesh or netting 162 allows the portable, foldable, lightweight surf lounge chair 2 to more easily and quickly dry out once the chair 2 has been removed from the body of water.

Figure 12:
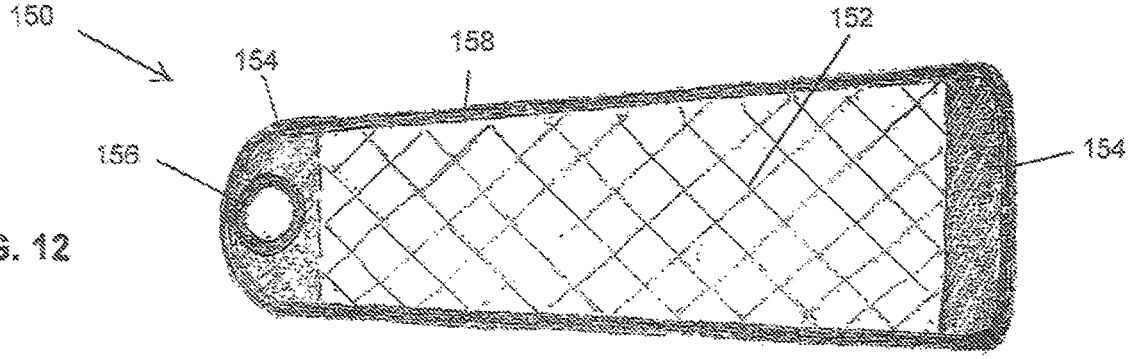
FIG. 12 is a schematic, top view of the arm rest assembly of the portable, foldable, lightweight surf lounge chair, constructed according to the present invention.

With respect to arm rest assembly 150, attention is now directed to FIG. 12. As shown in FIG. 12, arm rest assembly 150 includes mesh or netting 152, reinforced ends 154, conventional beverage holder 156, and piping trim 158. It is to be understood that mesh or netting 152 should be constructed of substantially the same material as mesh or netting 172. Also, reinforced ends 154 should be constructed of substantially the same material as reinforced corners 174. Also, piping trim 158 should be constructed of substantially the same material as piping trim 178. Finally, it is to be understood that conventional beverage holder 156 is conventionally located in one of the reinforced ends 154. It is to be understood that there are two (2) arm rest assemblies 150 and that the overall size of each arm rest assembly 150 should be that it adequately allows the end user to rest his/her arms on the arm rest assemblies 150 when the portable, foldable, lightweight surf lounge chair 2 is unfolded.

A further unique aspect of the present invention is the use of arm rest assembly 150. In particular, the arm rest assembly 150 includes the mesh or netting 152 that allows the water to flow through the portable, foldable, lightweight surf lounge chair 2 to ensure that the portable, foldable, lightweight surf lounge chair 2 remains anchored to the bottom 4 (FIG. 13) of the body of water. Also, the mesh or netting 152 allows the portable, foldable, lightweight surf lounge chair 2 to more easily and quickly dry out once the chair 2 has been removed from the body of water.

Construction of Portable, Foldable, Lightweight Surf Lounge Chair

Attention is now directed back to FIGS. 1-12. In order to construct portable, foldable, lightweight surf lounge chair 2, front and rear cross-bar assemblies 100 and side cross bar assemblies 200 are conventionally constructed. Front and rear cross-bar assemblies 100 are then conventionally attached to connectors 60 and 64 by fasteners 62 and 66, respectively. After the front and rear cross-bar assemblies 100 are attached to connectors 60 and 64, side cross bar assemblies 200 are conventionally attached to connectors 60 and 64 by fasteners 63 and 67, respectively. It is to be understood that side cross bar assemblies 200 can be attached prior to the attachment of front and rear cross-bar assemblies 100.

Once front and rear cross-bar assemblies 100 and side cross bar assemblies 200 have been attached, seat rest assembly 170, arm rest assemblies 150, and back rest assembly 160 can be conventionally attached to outer legs 52. It is to be understood that arm rest extensions 68 are attached to outer leg 52 and then arm rest assemblies 150 are attached at one end to arm rest extension 68.

After seat rest assembly 170, arm rest assemblies 150, and back rest assembly 160 have been conventionally attached to outer legs 52, leg extension tip 56 is located with inner leg 252, as shown in FIGS. 7 and 8. Finally, inner leg assembly 250 is located within outer leg 52.

Operation of Portable, Foldable, Lightweight Surf Lounge Chair

During the operation of portable, foldable, lightweight surf lounge chair 2, assume that the end user is planning on using the portable, foldable, lightweight surf lounge chair 2 to relax in a local lake. The end user then takes the portable, foldable, lightweight surf lounge chair 2 to the lake and goes out into the lake the desired depth. The end user then places the portable, foldable, lightweight surf lounge chair 2 into the lake in order to determine how high the end user needs to adjust the length between the lower leg extension assembly 50 and the inner leg assembly 250 so that the end user is seated at the proper depth in the lake.

Figure 13:
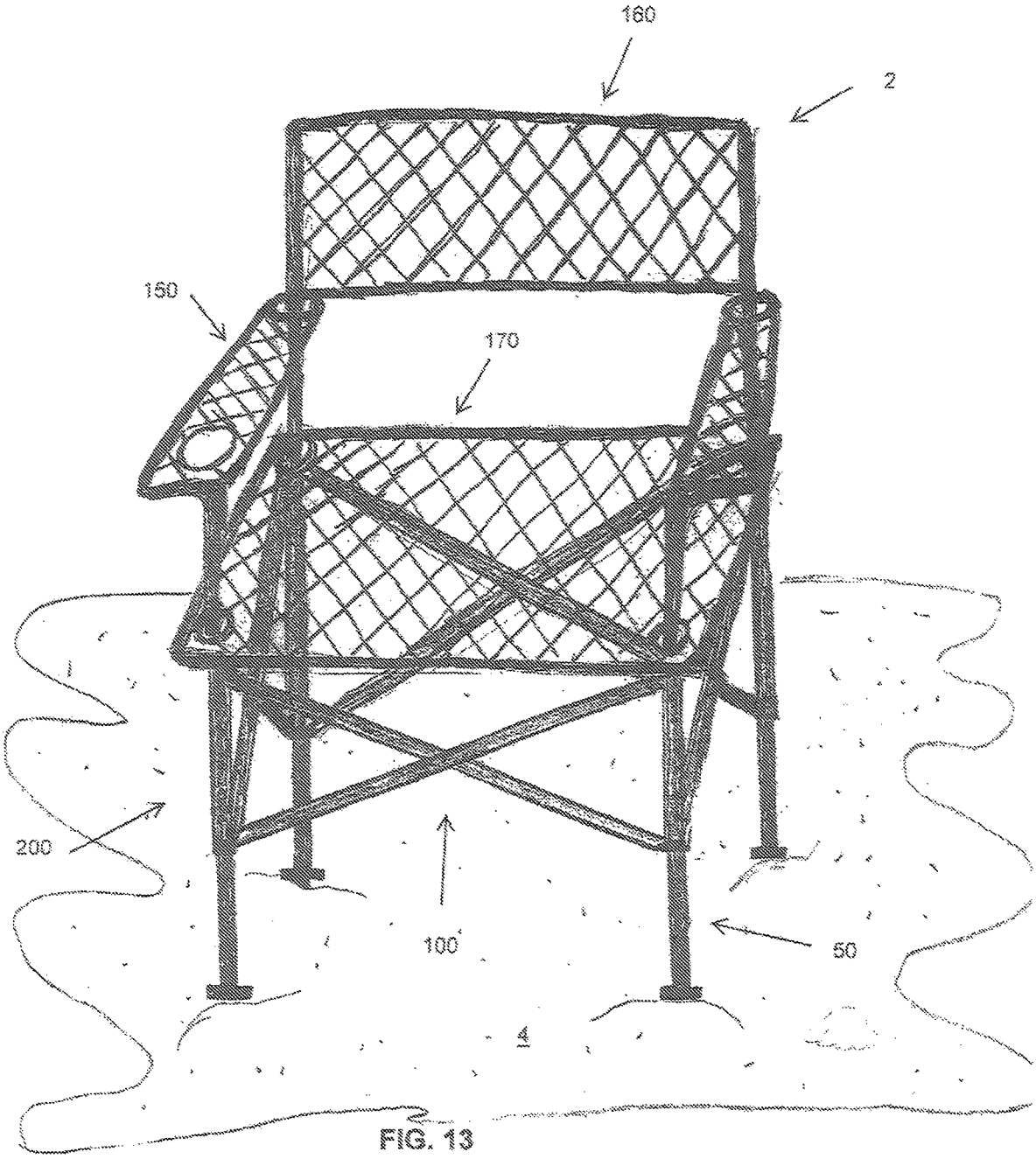
FIG. 13 is a schematic, isometric view of a portable, foldable, lightweight surf lounge chair being located within a bottom of a body of water, according to the present invention.

The end user than pushes or otherwise interacts with push button 72 on inner leg assembly 250 and adjusts the length between inner leg assembly 50 and outer leg assembly 250 to the desired length. The end user then locates the portable, foldable, lightweight surf lounge chair 2 back into the lake and pushes on portable, foldable, lightweight surf lounge chair 2 so that the stabilizing plate 54 and the leg extension tip 56 are sufficiently located within a desired amount of the bottom 4 of the lake, as shown in FIG. 13. In this manner, stabilizing plate 54 and the leg extension tip 56 act as anchors in assisting in keeping portable, foldable, lightweight surf lounge chair 2 in place if the end user gets out of portable, foldable, lightweight surf lounge chair 2.

As discussed above, another unique aspect of the present invention is the use of seat assembly 170, back rest assembly 160, and arm rest assembly 150. In particular, seat assembly 170, back rest assembly 160, and arm rest assembly 150 include the mesh or netting 152 that allows the water to flow through the portable, foldable, lightweight surf lounge chair 2 to ensure that the chair remains anchored to the bottom 4 of the body of water. Furthermore, the use of the stabilizing plate 54 and the leg extension tip 56 act as anchors in assisting in keeping portable, foldable, lightweight surf lounge chair 2 in place if the end user gets out of portable, foldable, lightweight surf lounge chair 2.

After the end user has finished using the portable, foldable, lightweight surf lounge chair 2, the end user pulls the portable, foldable, lightweight surf lounge chair 2 so that the stabilizing plate 54 and the leg extension tip 56 become dislodged from the bottom 4 of the lake. The end user can then set the portable, foldable, lightweight surf lounge chair 2 on the bank of the lake in order to allow the portable, foldable, lightweight surf lounge chair 2 to quickly air dry.

A still another unique aspect of the present invention is the use of drain hole 258 (FIG. 7). Drain hole 258 allows water to drain out of inner leg assemblies 250 after the portable, foldable, lightweight surf lounge chair 2 has been placed on the bank of the lake in order to air dry. In this manner, the likelihood of portable, foldable, lightweight surf lounge chair 2 rusting or corroding due to water being trapped within inner leg assemblies 250 is substantially reduced. Also, the mesh or netting 172 allows the portable, foldable, lightweight surf lounge chair 2 to more easily and quickly dry out once the chair 2 has been removed from the body of water.

Once the portable, foldable, lightweight surf lounge chair 2 has completely dried, the end user can conventionally fold up the portable, foldable, lightweight surf lounge chair 2 as is well known in the prior art. The end user can then place the folded up portable, foldable, lightweight surf lounge chair 2 in a conventional carrying bag (not shown) for easy transportation back to the end user's vehicle.

The preceding merely illustrates the principles of the invention. It will thus be appreciated that those skilled in the art will be able to devise various arrangements which, although not explicitly described or shown herein, embody the principles of the invention and are included within its spirit and scope. Furthermore, all examples and conditional language recited herein are principally intended expressly to be only for pedagogical purposes and to aid the reader in understanding the principles of the invention and the concepts contributed by the inventors to furthering the art, and are to be construed as being without limitation to such specifically recited examples and conditions. Moreover, all statements herein reciting principles, aspects, and embodiments of the invention, as well as specific examples thereof, are intended to encompass both structural and functional equivalents thereof. Additionally, it is intended that such equivalents include both currently known equivalents and equivalents developed in the future, i.e., any elements developed that perform the same function, regardless of structure.

This description of the exemplary embodiments is intended to be read in connection with the figures of the accompanying drawing, which are to be considered part of the entire written description. In the description, relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

All patents, publications, scientific articles, web sites, and other documents and materials referenced or mentioned herein are indicative of the levels of skill of those skilled in the art to which the invention pertains, and each such referenced document and material is hereby incorporated by reference to the same extent as if it had been incorporated by reference in its entirety individually or set forth herein in its entirety.

The applicant reserves the right to physically incorporate into this specification any and all materials and information from any such patents, publications, scientific articles, web sites, electronically available information, and other referenced materials or documents to the extent such incorporated materials and information are not inconsistent with the description herein.

The written description portion of this patent includes all claims. Furthermore, all claims, including all original claims as well as all claims from any and all priority documents, are hereby incorporated by reference in their entirety into the written description portion of the specification, and Applicant(s) reserve the right to physically incorporate into the written description or any other portion of the application, any and all such claims. Thus, for example, under no circumstances may the patent be interpreted as allegedly not providing a written description for a claim on the assertion that the precise wording of the claim is not set forth in haec verba in written description portion of the patent.

The claims will be interpreted according to law. However, and notwithstanding the alleged or perceived ease or difficulty of interpreting any claim or portion thereof, under no circumstances may any adjustment or amendment of a claim or any portion thereof during prosecution of the application or applications leading to this patent be interpreted as having forfeited any right to any and all equivalents thereof that do not form a part of the prior art.

All of the features disclosed in this specification may be combined in any combination. Thus, unless expressly stated otherwise, each feature disclosed is only an example of a generic series of equivalent or similar features.

It is to be understood that while the invention has been described in conjunction with the detailed description thereof, the foregoing description is intended to illustrate and not limit the scope of the invention, which is defined by the scope of the appended claims. Thus, from the foregoing, it will be appreciated that, although specific embodiments of the invention have been described herein for the purpose of illustration, various modifications may be made without deviating from the spirit and scope of the invention. Other aspects, advantages, and modifications are within the scope of the following claims and the present invention is not limited except as by the appended claims.

The specific methods and compositions described herein are representative of preferred embodiments and are exemplary and not intended as limitations on the scope of the invention. Other objects, aspects, and embodiments will occur to those skilled in the art upon consideration of this specification, and are encompassed within the spirit of the invention as defined by the scope of the claims. It will be readily apparent to one skilled in the art that varying substitutions and modifications may be made to the invention disclosed herein without departing from the scope and spirit of the invention. The invention illustratively described herein suitably may be practiced in the absence of any element or elements, or limitation or limitations, which is not specifically disclosed herein as essential. Thus, for example, in each instance herein, in embodiments or examples of the present invention, the terms "comprising", "including", "containing", etc. are to be read expansively and without limitation. The methods and processes illustratively described herein suitably may be practiced in differing orders of steps, and that they are not necessarily restricted to the orders of steps indicated herein or in the claims.

The terms and expressions that have been employed are used as terms of description and not of limitation, and there is no intent in the use of such terms and expressions to exclude any equivalent of the features shown and described or portions thereof, but it is recognized that various modifications are possible within the scope of the invention as claimed. Thus, it will be understood that although the present invention has been specifically disclosed by various embodiments and/or preferred embodiments and optional features, any and all modifications and variations of the concepts herein disclosed that may be resorted to by those skilled in the art are considered to be within the scope of this invention as defined by the appended claims.

The invention has been described broadly and generically herein. Each of the narrower species and sub-generic groupings falling within the generic disclosure also form part of the invention. This includes the generic description of the invention with a proviso or negative limitation removing any subject matter from the genus, regardless of whether or not the excised material is specifically recited herein.

It is also to be understood that as used herein and in the appended claims, the singular forms "a," "an," and "the" include plural reference unless the context clearly dictates otherwise, the term "X and/or Y" means "X" or "Y" or both "X" and "Y", and the letter "s" following a noun designates both the plural and singular forms of that noun. In addition, where features or aspects of the invention are described in terms of Markush groups, it is intended and those skilled in the art will recognize, that the invention embraces and is also thereby described in terms of any individual member or subgroup of members of the Markush group.

Other embodiments are within the following claims. Therefore, the patent may not be interpreted to be limited to the specific examples or embodiments or methods specifically and/or expressly disclosed herein. Under no circumstances may the patent be interpreted to be limited by any statement made by any Examiner or any other official or employee of the Patent and Trademark Office unless such statement is specifically and without qualification or reservation expressly adopted in a responsive writing by Applicants.

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

Other modifications and implementations will occur to those skilled in the art without departing from the spirit and the scope of the invention as claimed. Accordingly, the description hereinabove is not intended to limit the invention, except as indicated in the appended claims.

Therefore, provided herein is a new and improved portable, foldable, lightweight surf lounge. The preferred portable, foldable, lightweight chair, according to various embodiments of the present invention, offers the following advantages: ease of use; lightness in weight; durability; rust resistance; corrosion resistance; the ability to use the chair in up to four (4) feet of water; the reduced likelihood that the chair will float away once the end user gets up from the chair; the ability to anchor the chair to the bottom of the body of water; portability; foldability; the ability to quickly dry out after use in the water; the ability to have the water quickly drain from the chair; and the ability to hold a person without collapsing. In fact, in many of the preferred embodiments, these advantages of ease of use, lightness in weight, durability, rust resistance, corrosion resistance, the ability to use the chair in up to four (4) feet of water, the reduced likelihood that the chair will float away once the end user gets up from the chair, the ability to anchor the chair to the bottom of the body of water, portability, foldability, the ability to quickly dry out after use in the water, the ability to have the water quickly drain from the chair, and the ability to hold a person without collapsing are optimized to an extent that is considerably higher than heretofore achieved in prior, known portable, foldable, lightweight chairs.

I claim:

1. A portable, foldable, lightweight chair for use in water, comprising:

a lower leg extension assembly;

an inner leg assembly, wherein the inner leg assembly is located within one end of the lower leg extension assembly such that a length between the lower leg extension assembly and the inner leg assembly is adjustable, wherein the inner leg assembly further comprises an extension tip operatively connected to one end of the inner leg assembly and a stabilizer located adjacent to the extension tip, wherein the inner leg assembly is further comprised of:

a plurality of inner legs wherein each of the plurality of inner legs is comprised of:

an end cap located on one end of each of the inner legs;

a push button located adjacent to the end cap, wherein the push button interacts with the plurality of openings once each of the inner legs is located with the outer leg;

an inner leg opening located at the other end of each of the inner legs such that the extension tip is removably located within the inner leg opening; and a drain hole located adjacent to the inner leg opening;

a front cross-bar assembly operatively connected to the one end of the lower leg extension assembly;

a rear cross-bar assembly operatively connected to the one end of the lower leg extension assembly;

a plurality of side cross bar assemblies, wherein each side cross assembly is operatively connected to the one end of the lower leg extension assembly and each side cross assembly is located adjacent to the front cross-bar assembly and the rear cross-bar assembly;

a back rest assembly operatively connected to another end of the lower leg extension assembly;

a plurality of arm rest assemblies operatively connected to the lower leg extension assembly, wherein each of the arm rest assemblies is located adjacent to the back rest assembly; and a seat assembly operatively connected to the lower leg extension assembly, wherein the seat assembly is located adjacent to the plurality of arm rest assemblies.

2. The chair, according to claim 1, wherein the lower leg extension assembly is further comprised of:

a plurality of outer legs, wherein each of the outer legs includes a plurality of openings located along a portion of each of the outer legs.

3. The chair, according to claim 1, wherein the stabilizer is further comprised of:

a stabilizer plate.

4. The chair, according to claim 1, wherein the back rest assembly is further comprised of:

a plurality of reinforced ends;

a piping trim operatively connected to each of the plurality of reinforced ends; and a mesh operatively connected to the plurality of reinforced ends and the piping trim.

5. The chair, according to claim 1, wherein the plurality of arm rest assemblies is further comprised of:

a plurality of reinforced ends;

a piping trim operatively connected to each of the plurality of reinforced ends; and a mesh operatively connected to the plurality of reinforced ends and the piping trim.

6. The chair, according to claim 1, wherein the seat assembly is further comprised of:

a plurality of reinforced corners, wherein each of the plurality of reinforced corners includes an opening;

a piping trim operatively connected to each of the plurality of reinforced corners; and a mesh operatively connected to the plurality of reinforced corners and the piping trim.

7. A surf lounge chair for use in water, comprising:

a lower leg extension assembly;

an inner leg assembly, wherein the inner leg assembly is located within one end of the lower leg extension assembly such that a length between the lower leg extension assembly and the inner leg assembly is adjustable, wherein the inner leg assembly further comprises an extension tip operatively connected to one end of the inner leg assembly and a stabilizer located adjacent to the extension tip, wherein the inner leg assembly is further comprised of:

a plurality of innerlegs wherein each of the plurality of innerlegs is comprised of:

an end cap located on one end of each of the innerlegs:

a push button located adjacent to the end cap, wherein the push button interacts with the plurality of openings once each of the innerlegs is located with the outer leg;

an inner leg opening located at the other end of each of the innerlegs such that the extension tip is removably located within the inner leg opening; and a drain hole located adjacent to the inner leg opening;

a front cross-bar assembly operatively connected to the one end of the lower leg extension assembly;

a rear cross-bar assembly operatively connected to the one end of the lower leg extension assembly;

a plurality of side cross bar assemblies, wherein each side cross assembly is operatively connected to the one end of the lower leg extension assembly and each side cross assembly is located adjacent to the front cross-bar assembly and the rear cross-bar assembly;

a back rest assembly operatively connected to another end of the lower leg extension assembly;

a plurality of arm rest assemblies operatively connected to the lower leg extension assembly, wherein each of the arm rest assemblies is located adjacent to the back rest assembly; and a seat assembly operatively connected to the lower leg extension assembly, wherein the seat assembly is located adjacent to the plurality of arm rest assemblies.

8. The surf lounge chair, according to claim 7, wherein the lower leg extension assembly is further comprised of:

a plurality of outer legs, wherein each of the outer legs includes a plurality of openings located along a portion of each of the outer legs.

9. The surf lounge chair, according to claim 7, wherein the stabilizer is further comprised of:

a stabilizer plate.

10. The surf lounge chair, according to claim 7, wherein the back rest assembly is further comprised of:

a plurality of reinforced ends;

a piping trim operatively connected to each of the plurality of reinforced ends; and a mesh operatively connected to the plurality of reinforced ends and the piping trim.

11. The surf lounge chair, according to claim 7, wherein the plurality of arm rest assemblies is further comprised of:

a plurality of reinforced ends;

a piping trim operatively connected to each of the plurality of reinforced ends; and a mesh operatively connected to the plurality of reinforced ends and the piping trim.

12. The surf lounge chair, according to claim 7, wherein the seat assembly is further comprised of:

a plurality of reinforced corners, wherein each of the plurality of reinforced corners includes an opening;

a piping trim operatively connected to each of the plurality of reinforced corners; and a mesh operatively connected to the plurality of reinforced corners and the piping trim.

13. A method of using a portable, foldable, lightweight chair in water, comprising the steps of:

providing a lower leg extension assembly;

providing an inner leg assembly, wherein the inner leg assembly is located within one end of the lower leg extension assembly such that a length between the lower leg extension assembly and the inner leg assembly is adjustable, wherein the inner leg assembly further comprises an extension tip operatively connected to one end of the inner leg assembly and a stabilizer located adjacent to the extension tip, wherein the step of providing the inner leg assembly is further comprised of the steps of:

providing a plurality of innerlegs wherein each of the plurality of innerlegs is comprised of:

providing an end cap located on one end of each of the innerlegs:

providing an inner leg opening located at the other end of each of the inner legs such that the extension tip is removably located within the inner leg opening;

providing a drain hole located adjacent to the inner leg opening;

providing a push button located adjacent to the end cap, wherein the step of adjusting the length between the lower leg extension assembly and the inner leg assembly push button interacts with the plurality of openings once each of the inner legs is located with the outer leg, wherein the length between the lower leg extension assembly and the inner leg assembly is adjusted by:

pushing on the push button;

sliding the inner leg within the outer leg until a desired length between the lower leg extension assembly and the inner leg assembly is achieved; and locating the push button within one of the openings in the outer leg in order to maintain the desired length between the lower leg extension assembly and the inner leg assembly;

providing a front cross-bar assembly operatively connected to the one end of the lower leg extension assembly;

providing a rear cross-bar assembly operatively connected to the one end of the lower leg extension assembly;

providing a plurality of side cross bar assemblies, wherein each side cross assembly is operatively connected to the one end of the lower leg extension assembly and each side cross assembly is located adjacent to the front cross-bar assembly and the rear cross-bar assembly;

providing a back rest assembly operatively connected to another end of the lower leg extension assembly;

providing a plurality of arm rest assemblies operatively connected to the lower leg extension assembly, wherein each of the arm rest assemblies is located adjacent to the back rest assembly; and providing a seat assembly operatively connected to the lower leg extension assembly, wherein the seat assembly is located adjacent to the plurality of arm rest assemblies.

14. The method, according to claim 13, wherein the step of providing the lower leg extension assembly is further comprised of the step of:

providing a plurality of outer legs, wherein each of the outer legs includes a plurality of openings located along a portion of each of the outer legs.

15. The method, according to claim 13, wherein the step of providing the back rest assembly is further comprised of the steps of:

providing a plurality of reinforced ends;

providing a piping trim operatively connected to each of the plurality of reinforced ends; and providing a mesh operatively connected to the plurality of reinforced ends and the piping trim.

16. The method, according to claim 15, wherein the step of providing the arm rest assemblies is further comprised of the steps of:

providing a plurality of reinforced ends;

providing a piping trim operatively connected to each of the plurality of reinforced ends; and providing a mesh operatively connected to the plurality of reinforced ends and the piping trim.

17. The method, according to claim 15, wherein the step of providing the seat assembly is further comprised of the steps of:

providing a plurality of reinforced corners, wherein each of the plurality of reinforced corners includes an opening;

providing a piping trim operatively connected to each of the plurality of reinforced corners; and providing a mesh operatively connected to the plurality of reinforced corners and the piping trim.

* * * * *